US005964602A

United States Patent [19]

Aoki et al.

[11] Patent Number: 5,964,602

[45] Date of Patent: Oct. 12, 1999

[54] CONNECTOR FITTING STRUCTURE AND METHOD

[75] Inventors: Hiroshi Aoki; Osamu Sugiyama; Motohisa Kashiyama; Norio Matsumura; Haruki Yoshida, all of Shizuoka-ken, Japan

[73] Assignee: Yazaki Corporation, Tokyo, Japan

[21] Appl. No.: 08/877,879

[22] Filed: Jun. 18, 1997

[30] Foreign Application Priority Data

Jun. 27, 1996 [JP] Japan ..... 8-167635

[51] Int. Cl.[6] ..... H01R 13/62

[52] U.S. Cl. ..... 439/157; 439/347; 439/310

[58] Field of Search ..... 439/157, 347, 439/310

[56] References Cited

U.S. PATENT DOCUMENTS 4,586,771 5/1986 Kraemer et al. ..... 439/310
5,169,327 12/1992 Hatagishi ..... 439/157
5,326,279 7/1994 Sumida ..... 439/157
5,462,447 10/1995 Boiret et al. ..... 439/347
5,575,676 11/1996 Tsukakoshi et al. ..... 439/157
5,681,175 10/1997 Busse et al. ..... 439/157

*Primary Examiner*—Paula Bradley
*Assistant Examiner*—Cecelia Wright Brown
*Attorney, Agent, or Firm*—Finnegan, Henderson, Farabow, Garrett & Dunner, L.L.P.

[57] ABSTRACT

A hood assembly attached to a female connector includes slide members on the top and bottom thereof which are slid in a direction perpendicular to a fitting direction of male and female connectors. As a result of a movement of the slide members, guide pins provided on the male connector is guided by guide grooves provided on the slide members to pull the male connector into the hood assembly, thereby fitting the connectors to each other. A hood portion of the female connector is inserted between upper and lower flanges of the hood assembly with anchoring holes provided on the hood assembly and anchoring projections provided on the female connector in positions shifted from each other, and the hood assembly and the female connector are slid in this state into a normal position where the anchoring projections engage the anchoring holes.

4 Claims, 4 Drawing Sheets

CONNECTOR FITTING STRUCTURE AND METHOD

BACKGROUND OF THE INVENTION

1. Field of the Invention

The present invention relates to a connector fitting structure and a connector fitting method for fitting connectors in which a slide member provided on a hood assembly attached to either male or female connector is moved in a direction perpendicular to a direction in which the connectors are fitted to each other, and a guide pin provided on the other connector is guided by a guide groove provided on either the slide member or the other connector to pull the other connector into the first connector, thereby those connectors are fitted to each other. More specifically, the present invention relates to an assembling structure for assembling the hood assembly onto one of the connectors.

2. Description of the Related Art

As a related art, there is a connector fitting structure for fitting connectors proposed by the applicant in an unpublished application. In this type of the connector fitting structure, a male and a female connectors are fitted to each other by assembling one of the connector onto a hood assembly for moving the male and female connectors closer to each other and fitting them to each other, and by thereafter moving the other connector in the fitting direction using the hood assembly.

In the above-described configuration, when the hood assembly is assembled, for example, onto the female connector, the hood assembly is moved in the fitting direction in which the male and female connectors are fitted to each other in order to insert anchoring projections formed on the hood of the female connector into anchoring holes provided on anchoring tabs formed on upper amd lower sides of the hood defining peripheral portions of the hood assembly.

However, when the hood assembly is moved toward the female connector in the fitting direction in which the male and female connectores are fitted to each other to insert the anchoring projections into the anchoring holes porvided on the anchoring tabs, the upper and lower sides defining peripheral portions of the hood assembly are defected as a whole. It is therefore not easy to insert the anchoring projections formed on the hood of the male connector into the anchoring holes provided on the anchoring tabs, which has necessitated skillfulness during the assembling operation.

SUMMARY OF THE INVENTION

The present invention has been conceived to solve the above-described problem, and it is an object of the present invention to improve facilitate the operation of attaching a hood assembly to a connector, thereby improving operability.

In order to achieve the above-described object, according to a first aspect of the invention, there is provided a connector fitting structure for fitting a first and a second connector to each other using a hood assembly, comprising: a displacement regulating portion provided at one side of openings of the hood assembly; an anchoring tab formed at the one side of the openings of the hood assembly with a predetermined interval from the displacement regulating portion; a hood portion provided on the second connector to be inserted between the displacement regulating portion and the anchoring tab; an anchoring projection formed on the hood portion for expanding a gap between the displacement regulating portion and the anchoring tab, and for being engaged with an anchoring hole formed on the anchoring tab; and a first and a second slide member movable relative to each other in a direction intersecting a mutually engaged direction of the first and the second connectors for fitting the first and second connectors to each other with a cam mechanism provided between the first and second slide members and the first connector, wherein the anchoring projection is formed with an inclined surface for aiding the anchoring projection in inserting between the displacement regulating portion and the anchoring tab to expand the gap therebetween in the direction intersecting the mutually engaged direction.

According to a second aspect of the invention, as it depends from the first aspect, the thickness of the anchoring projection formed on the hood is larger than the gap between the displacement regulating portion and the anchoring tab.

In the construction above, the hood portion of the second connector is inserted between the displacement regulating portion provided at the one side of openings of the hood assembly and the anchoring tab formed with the predetermined interval from the displacement regulating portion. Then, the hood assembly is moved in the direction intersecting the mutually engaged direction of the first and the second connectors to insert the anchoring projection formed on the hood portion between the displacement regulating portion and the anchoring tab, and to expand the gap between the displacement regulating portion and the anchoring tab. Furthermore, the hood assembly is continuously moved in the direction intersecting the mutually engaged direction of the first and the second connectors to engage the anchoring projection with an anchoring hole formed on the anchoring tab. In addition, relative movement is caused between the first and the second slide members provided on the hood assembly movable relative to each other in the direction intersecting the mutually engaged direction for moving the first and second connectors in the mutually engaged direction to fit the first and second connectors to each other with the cam mechanism provided between the first and second slide members and the first connector.

When the anchoring projection formed on the hood portion is inserted between the displacement regulating portion and the anchoring tab, the inclination of the inclined surface formed on the anchoring projection is able to aid the anchoring projection in inserting between the displacement regulating portion and the anchoring tab to expand the gap therebetween in the direction intersecting the mutually engaged direction. Thus, operability during the attachment of the hood assembly to one of the connectors is further improved.

According to a third aspect of the invention, there is provided a structure for fitting connectors according to the present invention is a structure for attaching a hood assembly to a connector comprising: a displacement regulating portion which can be put in contact with external surfaces on upper and lower sides at the end of one of the connectors is provided such that it projects toward the connector; and inclined surfaces are provided on the anchoring projections on the end thereof facing the anchoring tabs with the hood assembly and the connector in positions shifted from each other in a direction perpendicular to the fitting direction of the connectors relative to positions where the anchoring holes and anchoring projections as described above engage.

With the above-described configuration, by fitting the hood assembly and one of the connectors in positions where the anchoring holes and anchoring projections are shifted from each other, the displacement regulating portion of the hood assembly is put in a position to hold both of the upper and lower sides of the connector externally. Then, by sliding the hood assembly and the connector from this state in a direction of moving the anchoring holes and anchoring projections toward each other, the inclined surfaces of the anchoring projections are caused to run on to the anchoring tabs with only the anchoring tabs deflected. Thus, the anchoring projections enter the anchoring holes.

Therefore, when the anchoring projections enter the anchoring holes after contacting the anchoring tabs, only part of the anchoring tabs are easily deflected by being urged by the inclined surfaces, the amount of the deflection being not excessive. Thus, operability during the attachment of the hood assembly to one of the connectors is further improved.

According to a fourth aspect of the invention, there is provided a connector fitting method for fitting first and second connectors to each other using a hood assembly, comprising the steps of: inserting a hood portion of the second connector between a displacement regulating portion provided at one side of openings of the hood assembly and an anchoring tab formed with a predetermined interval from the displacement regulating portion; moving the hood assembly in a direction intersecting a mutually engaged direction of the first and the second connectors to insert an anchoring projection formed on the hood portion between the displacement regulating portion and the anchoring tab, and to expand a gap between the displacement regulating portion and the anchoring tab; moving the hood assembly further in the direction intersecting the mutually engaged direction of the first and the second connectors to engage the anchoring projection with an anchoring hole formed on the anchoring tab; and causing relative movement between a first and a second slide members provided on the hood assembly movable relative to each other in the direction intersecting the mutually engaged direction for moving the first and second connectors in the mutually engaged direction to fit the first and second connectors to each other with a cam mechanism provided between the first and second slide members and the first connector.

According to a fifth aspect of the invention, as it depends from the fourth aspect, the connector fitting method further comprises the step of: using an inclination of an inclined surface formed on the anchoring projection for aiding the anchoring projection in inserting between the displacement regulating portion and the anchoring tab to expand the gap therebetween in the direction intersecting the mutually engaged direction.

With the above-described configuration, the hood portion of the second connector is inserted between the displacement regulating portion provided at the one side of openings of the hood assembly and the anchoring tab formed with the predetermined interval from the displacement regulating portion. Then, the hood assembly is moved in the direction intersecting the mutually engaged direction of the first and the second connectors to insert the anchoring projection formed on the hood portion between the displacement regulating portion and the anchoring tab, and to expand the gap between the displacement regulating portion and the anchoring tab. Furthermore, the hood assembly is continuously moved in the direction intersecting the mutually engaged direction of the first and the second connectors to engage the anchoring projection with an anchoring hole formed on the anchoring tab. In addition, relative movement is caused between the first and the second slide members provided on the hood assembly movable relative to each other in the direction intersecting the mutually engaged direction for moving the first and second connectors in the mutually engaged direction to fit the first and second connectors to each other with the cam mechanism provided between the first and second slide members and the first connector.

When the anchoring projection formed on the hood portion is inserted between the displacement regulating portion and the anchoring tab, the inclination of the inclined surface formed on the anchoring projection is enable to aid the anchoring projection in inserting between the displacement regulating portion and the anchoring tab to expand the gap therebetween in the direction intersecting the mutually engaged direction. Thus, operability during the attachment of the hood assembly to one of the connectors is further improved.

According to a sixth aspect of the invention, there is provided a method for fitting connectors according to the invention that is, a method of attaching a hood assembly to a connector, comprising the steps of: providing a displacement regulating portion which can be put in contact with external surfaces on upper and lower sides at the end of one of the connectors at one opening of the hood assembly such that it projects toward the connector; fitting the hood assembly and the connector such that the displacement regulating portion covers both of the upper and lower sides of the connector with the hood assembly and the connector in positions shifted from each other in a direction perpendicular to the fitting direction of the connectors relative to positions where the anchoring holes and anchoring projections as described above engage; and sliding the hood assembly and the connector relative to each other from that state such that the anchoring holes and anchoring projections are moved toward each other to engage the anchoring holes and anchoring projections each other.

With the above-described configuration, by fitting the hood assembly and one of the connectors in positions where the anchoring holes and anchoring projections are shifted from each other, the displacement regulating portion of the hood assembly is put in a position to hold both of the upper and lower sides of the connector externally. Then, the hood assembly and the connector are moved from this state in a direction of moving the anchoring holes and anchoring projections toward each other to cause the anchoring projections to enter and engage the anchoring holes. Thus, the displacement regulating portion is in contact with both of the upper and lower sides of the connector and, as a result, deflection of the hood assembly can be avoided even if the operator presses the hood assembly on both of the upper and lower sides thereof. This facilitates the operation of assembling the hood assembly to one of the connectors, thereby improving operability.

Therefore, when the anchoring projections enter the anchoring holes after contacting the anchoring tabs, only the part of the anchoring tabs are easily deflected by being urged by the inclined surfaces, the amount of the deflection being not excessive. Thus, operability during the attachment of the hood assembly to one of the connectors is further improved.

BRIEF DESCRIPTION OF THE ACCOMPANYING DRAWINGS

The above and further objects and novel features of the present invention will more fully appear from the following detailed description when the same is read in conjunction with the accompanying drawings, in which:

FIG. 1 is an exploded perspective view of a connector fitting structure for fitting connectors according to the present invention.

FIGS. 2A and 2B illustrate operations at an initial phase of the attachment of a hood assembly to a female connector which is an embodiment of the present invention. FIG. 2A is a sectional view of an engaging portion taken along a line IIA—IIA as viewed from a male connector. FIG. 2B is a sectional view of the left-hand side of the engaging portion shown in FIG. 2A.

FIGS. 3A and 3B illustrate operations at an intermediate phase of the attachment of a hood assembly to a female connector which is an embodiment of the present invention. FIG. 3A is a sectional view of an engaging portion taken along a line IIA—IIA as viewed from a male connector. FIG. 3B is a sectional view of the left-hand side of the engaging portion shown in FIG. 3A.

FIGS. 4A and 4B illustrate operations at a later phase of the attachment of a hood assembly to a female connector which is an embodiment of the present invention. FIG. 4A is a sectional view of an engaging portion taken along a line IIA—IIA as viewed from a male connector. FIG. 4B is a sectional view of the left-hand side of the engaging portion shown in FIG. 4A.

DETAILED DESCRIPTION OF THE PREFERRED EMBODIMENTS

Figure 1:
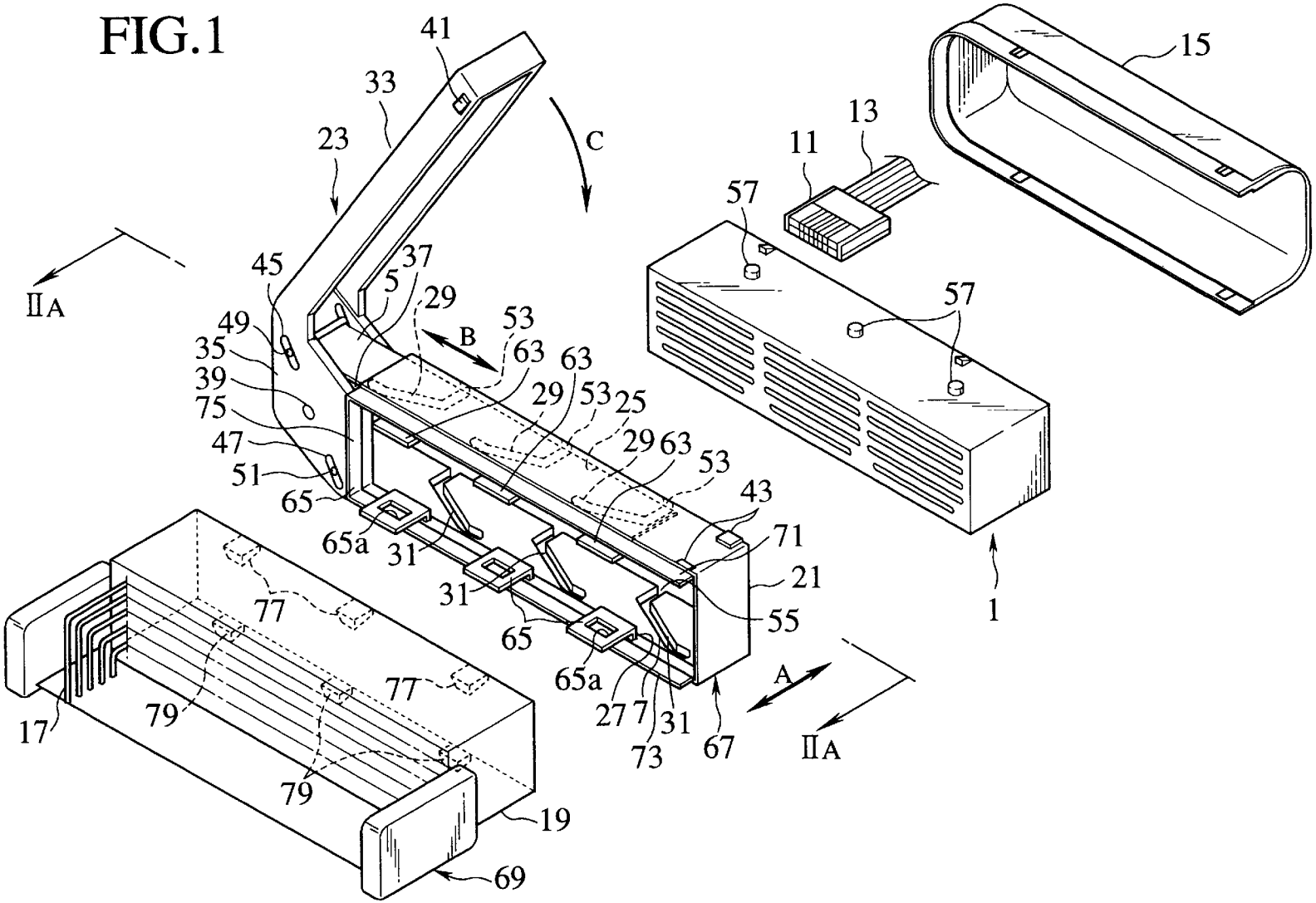

There will be detailed below the preferred embodiments of the present invention with reference to the accompanying drawings. Like members are designated by like reference characters.

FIG. 1 shows an example of a hood assembly 67 having a pair of upper and lower slide members 5 and 7 as a first and a second slide members which slide in the direction of the arrow B intersecting and perpendicular to the fitting direction of a male connector 1 and a female connector 69 as a mutually engaged direction indicated by the arrow A. The hood assembly 67 is provided as an element separate from a male connector 1 as a first connector and a female connector 69 as a second connector. A subconnector 11 is attached to the male connector 1 from the side opposite to the female connector 69, and a unshown solderless terminal (pressure contact terminal) connected to an electrical wire 13 is secured to the subconnector 11. A cover 15 is attached to the male connector 1 on the side thereof where the subconnector 11 is attached. Meanwhile, a pin terminal 17 is inserted through the female connector 69, one end of the terminal 17 being inserted into the solderless terminal. The other end of the pin terminal 17 is bent in the form of the letter "L" outside a hood portion 19 and is soldered to a printed circuit board (PCB) which is not shown.

In addition to the above-described slide members 5 and 7, the hood assembly 67 includes a hood 21 which can be attached to the female connector 69 at one opening thereof and into which receives the male connector 1 inserted from another opening thereof to cover the periphery of the male connector 1 and includes an operation lever 23 for sliding the slide members 5 and 7 to fit the male connector 1 and the female connector 69 to each other.

The pair of slide members 5 and 7 can be slid in opposite directions along slide grooves 25 and 27 formed inside both of the upper and lower sides of the hood 21. The slide members 5 and 7 are respectively formed with three each guide grooves 29 and 31 inclined relative to the moving direction of the slide members on sides of the slide members facing each other as portions of a cam mechanism, the guide grooves 29 and 31 are inclined in opposite directions. That is, the guide grooves 29 of the slide member 5 are open on the edge of one side thereof (the edge of the side toward the male connector 1 in FIG. 1) and formed to extend toward the operation lever 23, and the guide grooves 31 of the slide member 7 are open on the edge of one side thereof (the edge of the side toward the male connector 1 in FIG. 1) and formed to extend away from the operation lever 23.

The operation lever 23 includes a lever portion 33 and a pivoting portion 35 which can be pivoted about pivot pins 39 on both sides of a lever mounting portion 37 provided on an end face of the hood 21. The position of the lever portion 33 shown in FIG. 1 corresponds to an unfitted state of the connectors, and the connector is in a fitted state when the lever portion 33 is pivoted from this position in the direction of the arrow C into tight contact with the upper surface of the hood 21. At this time, a locking hole 41 at the end of the lever portion 33 engages a locking projection 43 on the upper surface of the hood 21 to be locked thereon.

The pivoting portion 35 is formed with slots 45 and 47 in opposite positions on both sides of the pivot pin 39. Mounting projections 49 and 51 provided at the ends of the pair of slide members 5 and 7, respectively, on the side of the operation lever 23 are rotatably inserted in the slots 45 and 47, respectively.

In the unfitted state of the connectors shown in FIG. 1, the side of the upper slide member 5 where the mounting projection 49 is provided projects from the slide groove 25, and the lower slide member 7 is entirely received in the slide groove 27. When the lever portion 33 is pivoted in the direction of the arrow C in this state, the upper slide member 5 is slid into the slide groove 25 and the lower slide member 7 is slid out of the slide groove 27.

The hood 21 is formed with notches 53 and 55 which respectively correspond to the openings on the edges on the side of guide grooves 29 and 31 in the above-described unfitted state of the connectors. On both of upper and lower sides of the male connector 1, there is provided guide pins 57 as other portions of the cam mechanism which respectively match the notches 53 and 55 and which are movably inserted in the guide grooves 29 and 31 when the connectors 1 and 69 are fitted to each other.

The female connector 69 is formed with three each anchoring projections 77 and 79 on the inner surfaces facing each other on upper and lower sides of the hood portion 19 thereof. On the upper and lower edges of the hood 21 on the side opposite to the notches 53 and 55, there is formed anchoring tabs 63 and 65 having respective anchoring holes 63a and 65a which are associated with the anchoring projections 77 and 79. By inserting the anchoring tabs 63 and 65 into the hood portion 19 to insert and anchor the anchoring projections 77 and 79 in the anchoring holes 63*a* and 65*a*, the hood assembly 67 is attached and to and assembled with the female connector 69.

When the male connector 1 is inserted into the hood 21 with the hood assembly 67 assembled with the female connector 69 and the operation lever 23 is pivoted in the direction of the arrow C with the guide pins 57 inserted in the guide grooves 29 and 31 through the notches 53 and 55, the slide members 5 and 7 are slid in opposite directions. As a result, the upper and lower guide pins 57 of the male connector 1 are guided respectively by the guide grooves 29 and 31 to pull the male connector 1 into the hood 21 and to fit the connectors to each other.

Figure 2A:
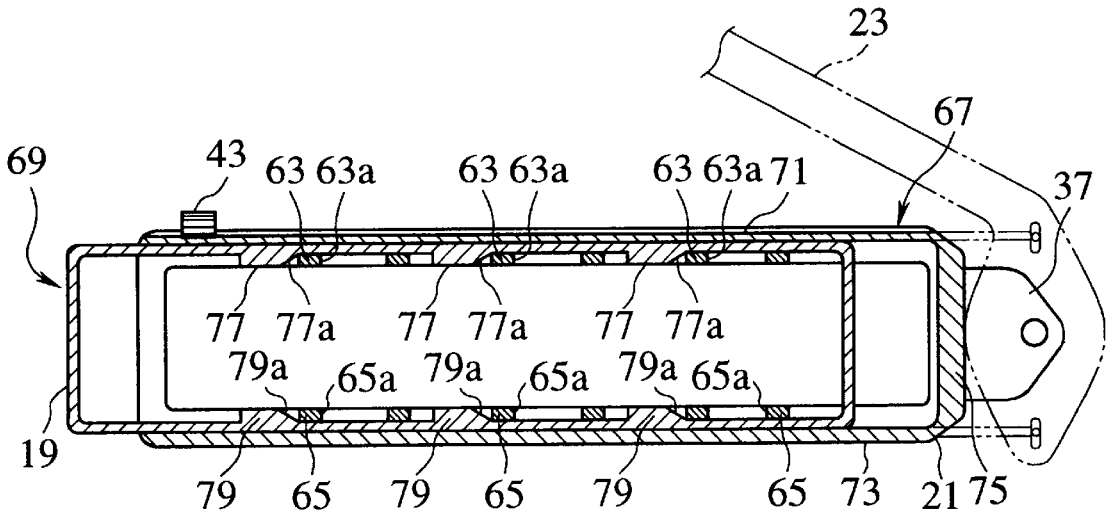
Figure 2B:
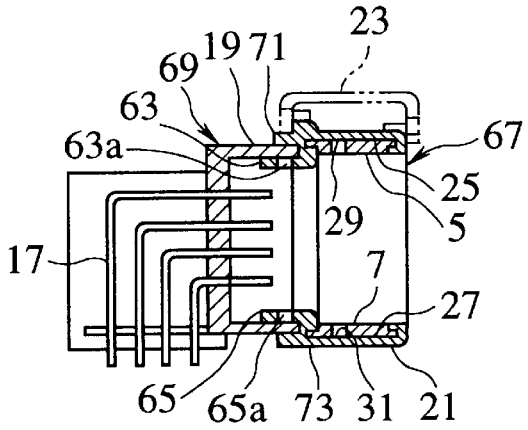
Figure 3A:
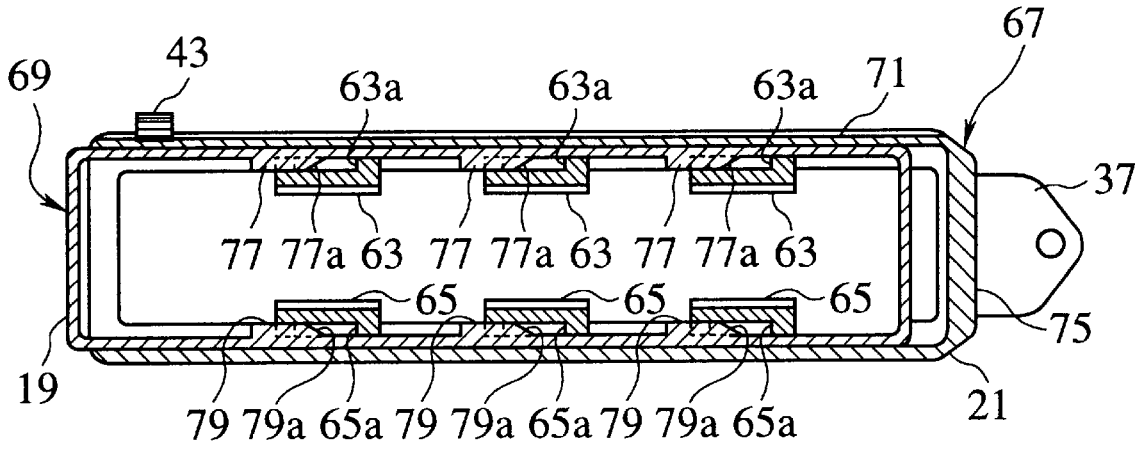
Figure 3B:
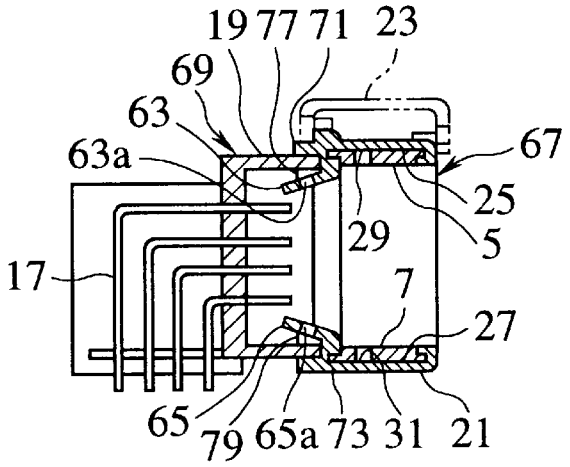
Figure 4A:
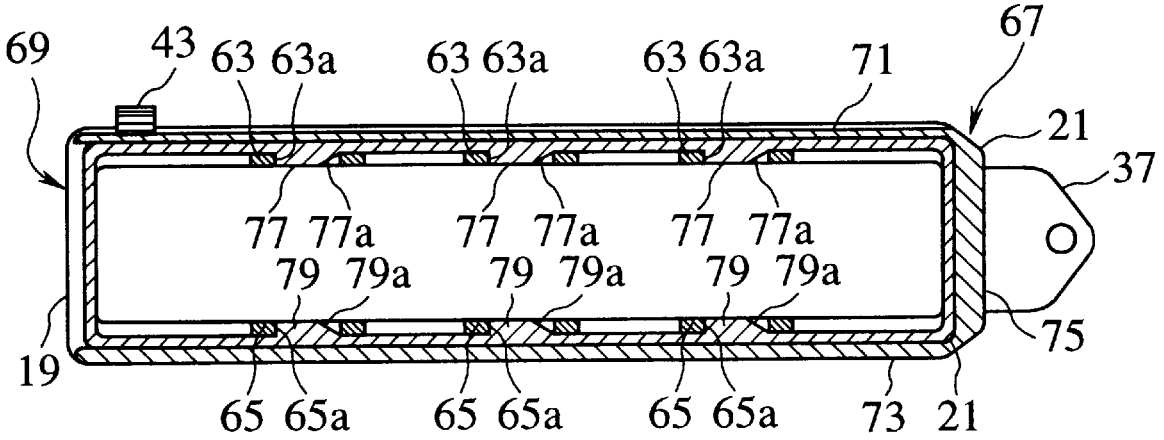
Figure 4B:
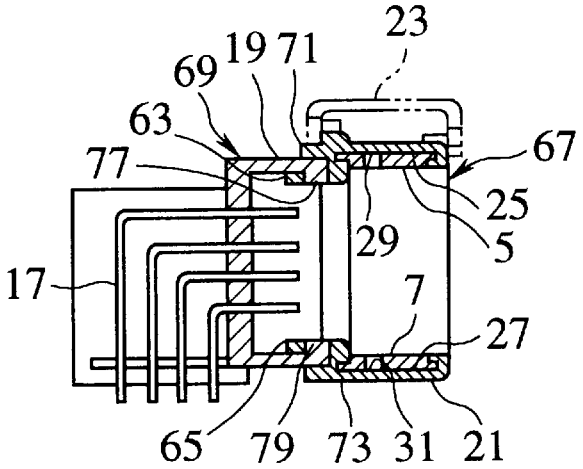

FIGS. 2A through 4B are illustrations of operations to describe a method of fitting a hood assembly to a connector according to one embodiment of the present invention. FIGS. 2A, 3A and 4A are sectional views of an engaging portion between a hood assembly 67 and a female connector 69 taken along a line IIA—IIA as viewed from the side of the male connector 1 in FIG. 1. FIGS. 2B, 3B and 4 Bare sectional views of the left-hand side of the engaging portion shown in FIGS. 2A, 3A and 4A. Like that shown in FIG. 1, the hood assembly 67 shown here includes a hood 21, a pair of slide members 5 and 7 movably inserted in slide grooves 25 and 27 on both of upper and lower sides of the hood 21, and an operation lever 23 for sliding the slide members 5 and 7 and is configured as an element separate from the female connector 69 and the male connector 1 as shown in FIG. 1.

As shown in FIG. 1, the female connector 69 can be attached to one opening (on the left-hand side in FIG. 2B) of the above-described hood assembly 67, and the male connector 1 is inserted from another opening (on the right-hand side in FIG. 2B). When the operation lever 23 is pivoted, guide pins 57 of the male connector 1 are guided by guide grooves 29 and 31 of the slide members 5 and 7 to pull the male connector 1 into the hood 21, thereby fitting the connectors to each other.

On both upper and lower sides of the hood assembly 67 at the side of one of the openings thereof, an upper flange 71 and a lower flange 73 are respectively formed as displacement regulating portions which can be put into contact with the outer surfaces of both of upper and lower sides of the female connector 69 at the end thereof. While the ends of the upper and lower flanges 71 and 73 shown on the right-hand side in FIG. 2A are connected to each other by a side flange 75, the opposite ends shown on the left-hand side are not connected to each other. In other words, the periphery of the hood 21 on the side of the opening which is attached to the female connector 69 includes the upper flange 71 and the lower flange 73 in the vertical direction and the side flange 75 on the right in the horizontal direction in FIG. 2A, and the left-hand side of the hood 21 is open.

On the inner surfaces of the upper flange 71 and the lower flange 73 facing each other, anchoring tabs 63 and 65 having anchoring holes 63*a* and 65*a* similar to those in FIG. 1 are provided on the hood 21 with a predetermined interval from the upper and the lower flanges 71 and 73. Therefore, predetermined gaps are formed between the upper flange 71 and the anchoring tab 63, and the lower flange 73 and the anchoring tab 65, respectively. Both of the predetermined gaps between the anchoring tab 63 and the upper flange 71 and between the anchoring tabs 65 and the lower flange 73 are formed slightly wider than the thickness of the hood portion 19 of the female connector 69 to allow the end of the hood portion 19 to be inserted easily. Meanwhile, anchoring projections 77 and 79 which can engage the anchoring holes 63*a* and 65*a* are formed on the inner surfaces facing each other of the hood portion 19 of the female connector 69 on the end thereof. In FIG. 2A, anchoring projections 77 and 79 are respectively formed with inclined surfaces 77*a* and 79*a* on the end faces at the right-hand side thereof. Furthermore, thickness of the anchoring projections 77 and 79 are larger than the gaps between the upper flange 71 and the anchoring tab 63, and the lower flange 73 and the anchoring tab 65, respectively.

With the structure for attaching a hood assembly to a connector as described above, to attach the hood assembly 67 to the female connector 69, as shown in FIG. 2A, the hood portion 19 of the female connector 69 is first slid into the gap between the upper flange 71 and the lower flange 73 of the hood assembly 67 with the female connector 69 in a position shifted to the left in FIG. 2A toward the side of the hood 21 where the periphery of the opening is not enclosed, i.e., shifted in the direction opposite to the operation lever 23 from the position where the anchoring tabs 63 and 65 and the anchoring projections 77 and 79 engage each other. At this time, the anchoring tabs 63 and 65 on the hood assembly 67 are inserted in the hood portion 19 of the female connector 69 as shown in FIG. 2B.

That is, the hood portion 19 of the female connector 69 is inserted in each of the gaps formed between the upper flange 71 and the lower flange 73 of the hood assembly 67 and the anchoring tabs 63 and 65, respectively. This operation of inserting the hood portion 19 into the gaps is easy to perform because the dimensions of the gaps are formed slightly wider than the thickness of the hood portion 19, and there is no need for deflecting the hood 21 of the hood assembly 67.

When the hood assembly 67 is slid to the left in FIG. 2A relative to the female connector 69 to put the anchoring tabs 63 and 65 and the anchoring projections 77 and 79 in contact with each other, as shown in FIGS. 3A and 3B, the inclined surfaces 77*a* and 79*a* of the anchoring projections 77 and 79 run on to the anchoring tabs 63 and 65, respectively, so as to deflect the anchoring tabs 63 and 65 in a direction of opening and expanding the same. When the hood assembly 67 is slid further in the same direction, as shown in FIGS. 4A and 4B, the anchoring projections 77 and 79 enter the anchoring holes 63*a* and 65*a*, respectively, and this completes the attachment of the hood assembly 67 to the female connector 69.

When the hood assembly 67 is slid relative to the female connector 69 to engage the anchoring projections 77 and 79 with the anchoring holes 63*a* and 65*a*, the operation can be carried out with no deflection of the hood 21 even if the operator presses both of the upper and lower sides of the hood 21 because the upper flange 71 and the lower flange 73 formed at one of the openings of the hood 21 are in contact with the hood portion 19 of the female connector 69. This prevents the anchoring tabs 63 and 65 from contacting pin terminals 17 of the female connector 69, thereby preventing the deformation of the pin terminals 17. In addition, the occurrence of fracture and cracking at the hood 21 is avoided, which facilitates the attaching operation and improves operability.

Further, when the anchoring projections 77 and 79 enter the anchoring holes 63*a* and 65*a* after coming into contact with the anchoring tabs 63 and 65, the anchoring tabs 63 and 65 are urged by the inclined surfaces 77*a* and 79*a* to be deflected easily in an amount which is not excessive. This further improves operability in attaching the hood assembly 67 to the female connector 69.

While preferred embodiments of the present invention have been described using specific terms, such description is for illustrative purposes, and it is to be understood that changes and variations may be made without departing from the spirit or scope of the following claim.

What is claimed is:

1. A connector fitting structure for connecting first and second connectors using a hood assembly, comprising:

the first connector having guide pins formed on an upper and lower surface for connecting the first connector to the hood assembly;

the second connector having a hood portion, wherein anchoring projections are formed on an upper and lower inner surface of the hood portion;

the hood assembly comprising a hood having a first opening connectable to the first connector and a second opening connectable to the second connector, wherein the first opening has an upper and lower surface defining notches therein for receiving the guide pins of the first connector, and wherein the second opening has flanges provided on an upper and lower surface defining a displacement regulating portion, and wherein the second opening has anchoring tabs projecting therefrom for connecting to the second connector anchoring projections, wherein the anchoring tabs are formed at a predetermined interval from the flanges, and wherein the anchoring tabs define anchoring holes therethrough for receiving the anchoring projections, the anchoring projections insertable between the flanges and the anchoring tabs;

a first and second slide member slidably connected to the hood, the slide members having guide grooves disposed therein for receiving the guide pins of the first connector, the guide grooves corresponding to the first opening notches, wherein the first slide member is slidable in an opposite direction from the second slide member; and an operating lever having a lever portion and a pivoting portion, the pivoting portion pivotally attached to the hood, wherein the pivoting portion has an upper and a lower end, wherein the upper end is connected to the first slide member and the lower end is connected to the second slide member wherein movement of the lever portion causes the first slide member to move in one direction and the second slide member to move in an opposite direction thereby defining a cam mechanism; and wherein the first and second connectors are engagable by the cam mechanism by pivotal movement of the operating lever when the guide pins are engaged with the guide grooves.

2. The connector fitting structure according to claim 1, wherein the thickness of said anchoring projections formed on said hood portion is larger than said predetermined interval between said flanges and the anchoring tabs.

3. A connector fitting method for fitting first and second connectors to each other using a hood assembly, comprising the steps of:

inserting a hood portion of said second connector between flanges provided at a first opening of said hood assembly on an upper and lower surface defining a displacement regulating portion and an anchoring tab formed on said first opening of said hood assembly with a predetermined interval from said flanges;

moving said hood assembly in a direction intersecting a mutually engaged direction of said hood portion between said flanges and said anchoring tab, and to expand a gap between said flanges and said anchoring tab;

moving said hood assembly further in the direction intersecting the mutually engaged direction of said first and said second connectors to insert an anchoring projection formed on said first and said second connectors to engage said anchoring projection of said second connector with said anchoring tab, said anchoring tab defining an anchoring hole therein; and causing relative movement between a first and a second slide member provided on said hood assembly movable relative to each other in the direction intersecting the mutually engaged direction for moving said first and second connectors in the mutually engaged direction to fit said first and second connectors to each other with a cam mechanism, wherein said cam mechanism is defined by an operating lever having a lever portion and a pivoting portion, said pivoting portion pivotally attached to a hood on said hood assembly, wherein said pivoting portion has an upper end and a lower end, wherein said upper end is connected to said first slide member and said lower end is connected to said second slide member, wherein movement of said lower portion causes said first slide member to move in one direction and said second slide member to move in an opposite direction and wherein said first and second connectors are engagable by said cam mechanism by pivotal movement of said operating lever when first connector guide pins are engaged with slide member guide grooves.

4. The connector fitting method according to claim 3, further comprising the step of:

using an inclination of an inclined surface formed on said anchoring projection for aiding said anchoring projection in inserting between said flanges and said anchoring tab to expand the gap therebetween in the direction intersecting the mutually engaged direction.

* * * * *

UNITED STATES PATENT AND TRADEMARK OFFICE

CERTIFICATE OF CORRECTION

PATENT NO. : 5,964,602
DATED : October 12, 1999
INVENTOR(S) : Hiroshi AOKI et al.

It is certified that error appears in the above-identified patent and that said Letters Patent is hereby corrected as shown below:

Claim 3, column 10, line 20, "mechanism," should read --mechanism;--.

Signed and Sealed this

Thirteenth Day of June, 2000

*Attest:*

Q. TODD DICKINSON

*Attesting Officer*

*Director of Patents and Trademarks*